United States Patent [19]

Greskovich et al.

[11] 4,141,781

[45] Feb. 27, 1979

[54] METHOD FOR RAPID REMOVAL OF CORES MADE OF $\beta Al_2O_3$ FROM DIRECTIONALLY SOLIDIFIED EUTECTIC AND SUPERALLOY AND SUPERALLOY MATERIALS

[75] Inventors: Charles D. Greskovich; Marcus P. Borom, both of Schenectady, N.Y.

[73] Assignee: General Electric Company, Schenectady, N.Y.

[21] Appl. No.: 839,991

[22] Filed: Oct. 6, 1977

[51] Int. Cl.[2] ..... B22D 29/00

[52] U.S. Cl. ..... 156/637; 134/22R; 134/29; 156/644; 156/656; 156/667; 164/131; 164/132

[58] Field of Search ..... 106/62, 73.2, 38.9, 106/63; 29/156.8 H, 156.8 T; 75/101 BE; 134/2, 22 R, 29, 19; 164/131, 132; 252/454, 455, 79.5, 477 R; 423/112, 119, 131, 600; 156/628, 655, 656, 667, 644, 637

[56] References Cited

U.S. PATENT DOCUMENTS

| | | | |
|---|---|---|---|
| 2,989,385 | 6/1961 | Gianbla et al. | 156/643 |
| 3,859,427 | 1/1975 | Francis et al. | 106/55 |
| 4,013,477 | 3/1977 | Jatkar et al. | 106/63 |
| 4,052,538 | 10/1977 | Eddy et al. | 423/600 |
| 4,068,048 | 1/1978 | Desplanches et al. | 423/600 |
| 4,073,662 | 2/1978 | Borom | 134/2 |

*Primary Examiner*—Jerome W. Massie

*Attorney, Agent, or Firm*—Donald M. Winegar; Joseph T. Cohen; Charles T. Watts

[57] ABSTRACT

Caustic solutions are employed in an autoclave process to rapidly remove cores made of $\beta$-$Al_2O_3$ from directionally solidified eutectic alloy and superalloy materials.

7 Claims, No Drawings

METHOD FOR RAPID REMOVAL OF CORES MADE OF $\beta Al_2O_3$ FROM DIRECTIONALLY SOLIDIFIED EUTECTIC AND SUPERALLOY AND SUPERALLOY MATERIALS

BACKGROUND OF THE INVENTION

1. Field of the Invention

This invention relates to improvements in investment casting and in particular to the rapid removal of cores made of $\beta$-$Al_2O_3$ employed in the casting process.

2. Description of the Prior Art

The production of directionally solidified (DS) metal eutectic alloys and superalloys for high pressure turbine (HPT) airfoils with intricate internal passageways for air cooling requires that the core and mold not only be dimensionally stable and sufficiently strong to contain and shape the casting but also be sufficiently weak to prevent mechanical rupture (hot tearing) of the casting during solidification and cooling. The DS process requirements of up to 1875° C. for a 16 hour time period imposes severe constraints on materials which may serve as mold or core candidates.

The currently available core materials do not possess the chemical stability required for casting eutectic alloy and superalloy materials. The prior art appears to be mostly limited to the use of silica or silica-zircon core and mold materials. At temperatures greater than 1600° C. the silica based materials fail from the standpoint of both mechanical integrity and chemical incompatibility with the advanced alloy compositions.

Aluminum oxide ($Al_2O_3$) by itself, without a chemical or physical binder material, has been identified as a potential core and mold material based on both chemical compatibility and leachability considerations.

In co-pending patent applications Ser. No. 775,762 now U.S. Pat. No. 4073662, and Ser. No. 839,990 filed Mar. 9, 1977 and Oct. 6, 1977, and assigned to the same assignee of this invention, alumina and alumina-based compound material compositions are disclosed for making improved cores for D.S. casting. In particular, the cores have a porosity of greater than about 20% by volume and have excellent crushability characteristics and are resistant to metal-core reaction. Depending upon processing techniques, the core may or may not have an integral dense alumina outer layer to prevent metal penetration. Cores made from the material compositions must be removed from the castings without any deleterious effect on the surface of the casting. However, $Al_2O_3$ and other dense advanced core materials such as $LaAlO_3$, $MgAlO_4$ and $Y_3Al_5O_{12}$ are not easily attacked by the conventional autoclave techniques used for $SiO_2$.

In co-pending application Ser. No. 775,761, filed on Mar. 9, 1977, now abandoned, and assigned to the same assignee as this invention, autoclave leaching of magnesia doped alumina is taught and claimed therein. It is the belief that the addition of the divalent alkaline earth cations into the trivalent cation lattice of $Al_2O_3$ introduces lattice defects which enhance the kinetics of the dissolution of alumina.

It is therefore an object of this invention to provide a new and improved method for removing $\beta$-alumina core material from directionally solidified eutectic alloy and superalloy materials.

Another object of this invention is to provide a new and improved method for the rapid removal of porous $\beta$-alumina core material by a caustic solution in an autoclave without adversely affecting the cast material.

Other objects of this invention will, in part, be obvious and will, in part, appear hereinafter.

BRIEF DESCRIPTION OF THE INVENTION

In accordance with the teachings of this invention there is provided a new and improved method for removing a ceramic material from an abutting contact relationship with a casting of an advanced superalloy material. The ceramic material is $\beta$-alumina ranging in composition from $Na_2O \cdot 9Al_2O_3$ to $Na_2O \cdot 11Al_2O_3$.

The microstructure of the ceramic material of the core is dependent upon the method of processing to make the fired core. In one instance it is characterized by a grain morphology characteristic of grains which have undergone vapor transport action and a network of narrow interconnecting bridges connecting adjacent grains and particles. The porosity content is in excess of about 35% by volume and is continuous throughout. A layer of dense alumina may be present about, and integral with the remainder of the core material. In a second instance the microstructure is characterized by an equiaxed grain morphology indicative of a standard sintering process.

The $\beta$-alumina ceramic material is removed by an autoclave leaching process at an elevated temperature and an elevated pressure. A solution of either KOH or NaOH comprises the leaching solution. The elevated temperature is at least about 200° C. and may range up to about 350° C. and higher. A preferred temperature for leaching is about 290° C. In the highly porous structure the leaching solution attacks the interconnecting alumina network and washes the remainder of undissolved material out of the casting by agitation of the solution and the ongoing chemical reaction.

In the instance where the core is of a density of 70% or greater, the leaching is facilitated by the disruptive exchange of a larger potassium ion of the KOH solution for a smaller sodium ion in the crystal structure. The leaching rate is dependent upon the total porosity content, by volume, of the $\beta$-$Al_2O_3$ ceramic material of the core. KOH is the preferred leaching agent.

Advanced superalloys, such as NiTaC-13, are not attacked by the core material or the leaching solutions.

DESCRIPTION OF THE INVENTION

A compact made of $\beta$-alumina materials $Na_2O \cdot 9Al_2O_3$ and $Na_2 \cdot 11Al_2O_3$, when fired, is suitable for use as a core in investment casting of directionally solidified eutectic and superalloy materials. The compact may have a single or a complex shape depending upon the complexity of structure of the turbine blade to be made by the casting process. The preferred material for the compact or core, as stated before, is an alumina-based material because casting temperatures are in excess of 1500° C. and directional solidification is practiced for 16 hours and more, with aluminum in the cast alloy being one of the most reactive elements.

The compact is manufactured from a material composition which is made essentially of 100% $\beta$-alumina or which may consist of a mixture of at least 60 parts by weight $\beta$-alumina, balance alumina. A sufficient amount of the material is pressed into a compact of a desired shape and heated to an elevated temperature of about 1600° C. to 1800° C. to sinter the material and make a fired ceramic core. The microstructure of the material of the fired core is characteristic of a continuous phase of $\beta$-$Al_2O_3$ formed in situ which coexists with an interconnected network of porosity, and when the alumina phase is present, a dispersion of particles of alumina exist within a matrix of $\beta$-alumina.

After a compact has been employed as a core in making a casting, and the casting has solidified thereabout, the core is removed from the casting by autoclave leaching employing either a KOH or a NaOH solution. A solution of from about 10 weight percent, of either KOH or NaOH in water up to saturation, about 70 weight percent in water, has been found to be satisfactory. The autoclave temperature is preferably greater than about 200° C. and may range upwards to at least about 350° C. and higher. The temperature preferably should not exceed about 290° C. The autoclave pressure is established by the vapor pressure above the liquid which results from the leaching process. The pressure in the autoclave leaching process may be from 200 psi to about 1250 psi. KOH is the preferred leaching agent.

The caustic leaching agent, during the autoclave leaching process, attacks the ceramic material of the core. The leaching agent dissolves the alumina of both the grains and the interconnecting bridges formed therebetween by interparticle sintering. When the bridges have been dissolved, the remainder of the core material, mostly grannular material, is physically washed out of the core cavity by agitation caused by the leaching process. Any remaining material may be removed by mechanical agitation after removal from the autoclave by such suitable means as ultrasonics and the like. It is believed that the dissolution of $\beta$-$Al_2O_3$ by KOH solution is facilitated by the disruptive exchange of a larger potassium ion for a smaller sodium ion in the crystal structure.

After autoclave leaching processing to remove the core, the casting is removed from the autoclave, washed in water and dried in a warm oven. The casting is then stored for further use or processed further as required.

Examination of castings of directionally solidified eutectic alloys and superalloy materials such, for example, as NiTaC-13, cast with the cores made of fired $\beta$-alumina material, revealed no apparent attack on the material. The surface finishes of the castings are acceptable regardless of whether the leaching agent is KOH or NaOH and regardless of the strength of the solutions of the same. The KOH and NaOH have no detrimental effect on the finish or integrity of the superalloy casting.

The NiTaC-13, as cast, had the following nominal composition, by weight percent:

Nickel: 63.4%
Chromium: 4.4%
Cobalt: 3.3%
Aluminum: 5.4%
Tungsten: 3.1%
Rhenium: 6.2%
Vanadium: 5.6%
Tantalum: 8.1%
Carbon: 0.48%

We claim as our invention:

1. A method for removing a core of $\beta$-alumina material from a casting comprising the process steps of:

(a) placing the casting containing the core of ceramic material in an autoclave including an aqueous leaching solution containing a material which is one selected from the group consisting of NaOH and KOH;

(b) heating the casting, ceramic material and leaching solution to a temperature of at least about 200° C.;

(c) dissolving substantially all of an interconnecting network of ceramic material formed in situ between grains of the material by sintering by chemical attack caused by the leaching solution, and (d) removing at least some of the undissolved ceramic material from the casting by the solution agitated by the chemical reaction.

2. The method of claim 1 wherein
the temperature in the autoclave is no greater than about 350° C.

3. The method of claim 1 wherein
the composition of the aqueous leaching solution is from about 10 percent by weight to about 70 percent by weight hydroxide and the balance water.

4. The method of claim 3 wherein
the hydroxide is KOH.

5. The method of claim 2 wherein
the temperature in the autoclave is about 290° C.

6. The method of claim 5 wherein
the composition of the aqueous leaching solution is from about 10 percent by weight to about 70 percent by weight hydroxide and the balance water.

7. The method of claim 6 wherein
the hydroxide is KOH.

* * * * *